US007510214B1

(12) United States Patent
Oxford

(10) Patent No.: US 7,510,214 B1
(45) Date of Patent: Mar. 31, 2009

(54) METHOD AND SYSTEM FOR ASSISTING INDIVIDUAL AMBULATION

(76) Inventor: Stuart G. Oxford, 13616 N. 78th St., Omaha, NE (US) 68122

( * ) Notice: Subject to any disclaimer, the term of this patent is extended or adjusted under 35 U.S.C. 154(b) by 867 days.

(21) Appl. No.: 10/953,568

(22) Filed: Dec. 6, 2004

(51) Int. Cl.
*A63B 22/14* (2006.01)
*A63G 13/00* (2006.01)

(52) U.S. Cl. ..... 280/827; 482/146; 482/147; 482/77

(58) Field of Classification Search ..... 482/146, 482/147, 77; 180/827
See application file for complete search history.

(56) References Cited

U.S. PATENT DOCUMENTS 5,242,180 A 9/1993 Bergeron
5,556,120 A 9/1996 Davis
5,897,474 A * 4/1999 Romero ..... 482/146
5,941,807 A * 8/1999 Cassidy et al. ..... 482/146
6,679,510 B2 1/2004 Perena
7,094,183 B2 * 8/2006 Hsieh ..... 482/51
7,112,168 B2 * 9/2006 Dalebout et al. ..... 482/146
7,137,938 B2 * 11/2006 Gottlieb ..... 482/146
7,370,734 B2 * 5/2008 Hallgrimsson ..... 188/31

* cited by examiner

*Primary Examiner*—Paul N Dickson
*Assistant Examiner*—Marlon A Arce Diaz
(74) *Attorney, Agent, or Firm*—Dennis L. Thomte; Thomte Patent Law Office LLC

(57) ABSTRACT

An ambulatory assistance device is provided, having a base that supports an individual in a generally upright position. A forward support frame is provided for engagement between the individual's upper extremities and the operating surface. Forward ambulation may be achieved by shifting the individual's mass toward one side of the device and then pulling on the support frame to pivot the opposite side of the device in a generally forward direction. Repeating the process in a mirror fashion moves the other side of the individual and the device in a generally forward direction. Optional platforms and foot restraints are provided for positioning and securing the individual on the base. Various base configurations are provided to adjust the performance of the device according to conditions.

25 Claims, 8 Drawing Sheets

12

12
22
16
14
20

12'

12'
22'
16'
14'
20'

12''

12''
22'
16''
14''
20''

12'''
32

12'''
22'''
16'''
14'''
20'''

12'v

12'v
22'v
16'v
14'v
20'v 12v
32

12v
22v
16v
14v
20v

METHOD AND SYSTEM FOR ASSISTING INDIVIDUAL AMBULATION

BACKGROUND OF THE INVENTION

1. Field of the Invention

The present invention relates to ambulatory assistance devices, and more particularly to an ambulatory assistance device that is capable of ambulating an individual, having partial or total lower body paralysis, in a standing position under the individual's own power.

2. Description of the Prior Art

Many devices have been known over the years to help ambulate individuals having varying degrees of lower body paralysis, cerebral palsy, and other such diseases and medical afflictions. One of the first types of ambulatory devices is the ubiquitous wheelchair, which provides a means for easily transporting the individual from one location to another. However, wheelchairs require the occupant to remain in a seated position and provides little therapeutic exercise, which typically leads to muscular atrophy.

Ambulation and mobility platforms, such as parapodiums, were later developed to provide a framework that provides firm support for an individual in a standing position. Some designs of this type of leg bracing enable the individual to become ambulatory with the use of crutches. Such systems require the individual to spend time each day in a standing position, which may reduce the incidence of atrophy in the lower limbs. The ambulation and mobility platforms may also provide the individual with the psychological benefit of being able to stand and participate in various activities. However, these systems are typically flawed by their complexity and bulk, which makes them difficult to use. Moreover, the complexity of such systems frequently necessitates a high cost of manufacture, which prevents those having limited means to acquire such systems.

Wheelstands typically provide a pivotable stretcher portion that moves between horizontal and vertical positions. Wheelstand frames are oftentimes provided with large driving wheels and pairs of stabilizer caster wheels that support the wheelstands and enable ambulation. While such devices enable individuals to be moved from horizontal or seated positions to a generally upright position, they suffer from a high degree of complexity in assembly and use. Moreover, the motive nature of the structure is provided by the wheels, which limits the amount of total body therapy and exercise that a user can obtain.

The prior art has provided other ambulatory assistance designs that increase the amount of exercise attainable by their users. For example, wheeled frames have been provided with various straps or vests to support the weight of the user, while mobility is achieved by a walking motion with the legs. Other systems provide complex leg bracing and electrical current that is passed into portions of the lower extremity to initiate a walking motion. Clearly, however, such systems are inapplicable to those of severe or complete paralysis of their lower extremities.

Accordingly, what is needed is an ambulatory assistance device and method of using the same that is simple to use, effectively ambulates its user in a generally upright position, and provides an adequate measure of total body exercise.

SUMMARY OF THE INVENTION

The system and method for assisting individual ambulation of the present invention is generally provided with an ambulation device that supports an individual in a generally upright, standing position. The ambulation device is comprised of a base, having a bottom portion and a peripheral edge portion, for the placement of the individual's lower extremities. A support frame is provided for selective manual engagement with the operating surface using the individual's upper extremities. In one embodiment, the support frame may be provided in the form of a walker, with or without wheels. Other embodiments may include a support frame that is simply provided by a pair of crutches, ski poles, or the like.

While standing on the ambulation device, the individual grasps the support frame and shifts a preponderance of the individual's mass to one side. The individual applies sufficient force to the support frame with the individual's upper extremities so that it remains in a static position with respect to the operating surface. The individual then pulls on the support frame with the individual's upper extremities so that the ambulation device pivots on the operating surface, beneath the individual's center of mass, causing the opposite side of the ambulation device to pivot toward the support frame. The individual then repeats the process, but after shifting his mass to the opposite side of the ambulation device. In this manner, pivoting steps provide the individual with forward motion.

In an alternate embodiment, the ambulation device can be provided with a platform to support the individual. Foot restraints may be coupled with the platform to accurately position the individual thereon. In one preferred embodiment, the foot restraints are pivotably coupled with the platform so that the individual's feet generally point in the forward direction as the ambulation device is pivoted and moved in a forward direction. A plurality of base designs are provided for the ambulation device to alter the pivoting and motive characteristics of the ambulation device.

It is therefore a principal object of the present invention to provide an ambulatory assistance device that ambulates an individual from one location to another, under the individual's manual power, without supporting a majority of the individual's body on a wheeled structure.

A further object of the present invention is to provide an ambulatory assistance device that incorporates the use of a forward support frame and a separate ambulation device that supports the individual in a generally upright position.

Still another object of the present invention is to provide an ambulatory assistance device that is actuated by the shifting of the user's mass to one side of the device and then pivoting the device with the user's upper extremities so the opposite side of the device is moved in a generally forward direction.

Yet another object of the present invention is to provide an ambulatory assistance device that provides the user with an easy means of ambulation and total-body, therapeutic exercise.

A further object of the present invention is to provide an ambulatory assistance device that is relatively simple and inexpensive in construction.

Still another object of the present invention is to provide an ambulatory assistance device that may be used by individuals of nearly any size and physical ability.

Yet another object of the present invention is to provide an ambulatory assistance device that is easily adaptable in design for use under a wide variety of environmental conditions.

A further object of the present invention is to provide an ambulatory assistance device, for ambulating its user in a generally vertical position, that incorporates the use of a forward support frame and an ambulation device, which are structurally linked with one another so that a pulling or pushing force may be applied to the ambulation device through the manipulation of the support frame by the user.

Still another object of the present invention is to provide an ambulatory assistance device that ambulates an individual in a generally vertical position with less energy expenditure than prior devices and methods.

Yet another object of the present invention is to provide an ambulatory assistance device, for ambulating an individual in a generally vertical position, having an adjustable level of anterior and posterior stability.

A further object of the present invention is to provide an ambulatory assistance device, for ambulating an individual in a generally vertical position, having an adjustable level of medial and lateral stability.

These and other objects of the present invention will be apparent to those skilled in the art.

DESCRIPTION OF THE PREFERRED EMBODIMENT

Figure 1:
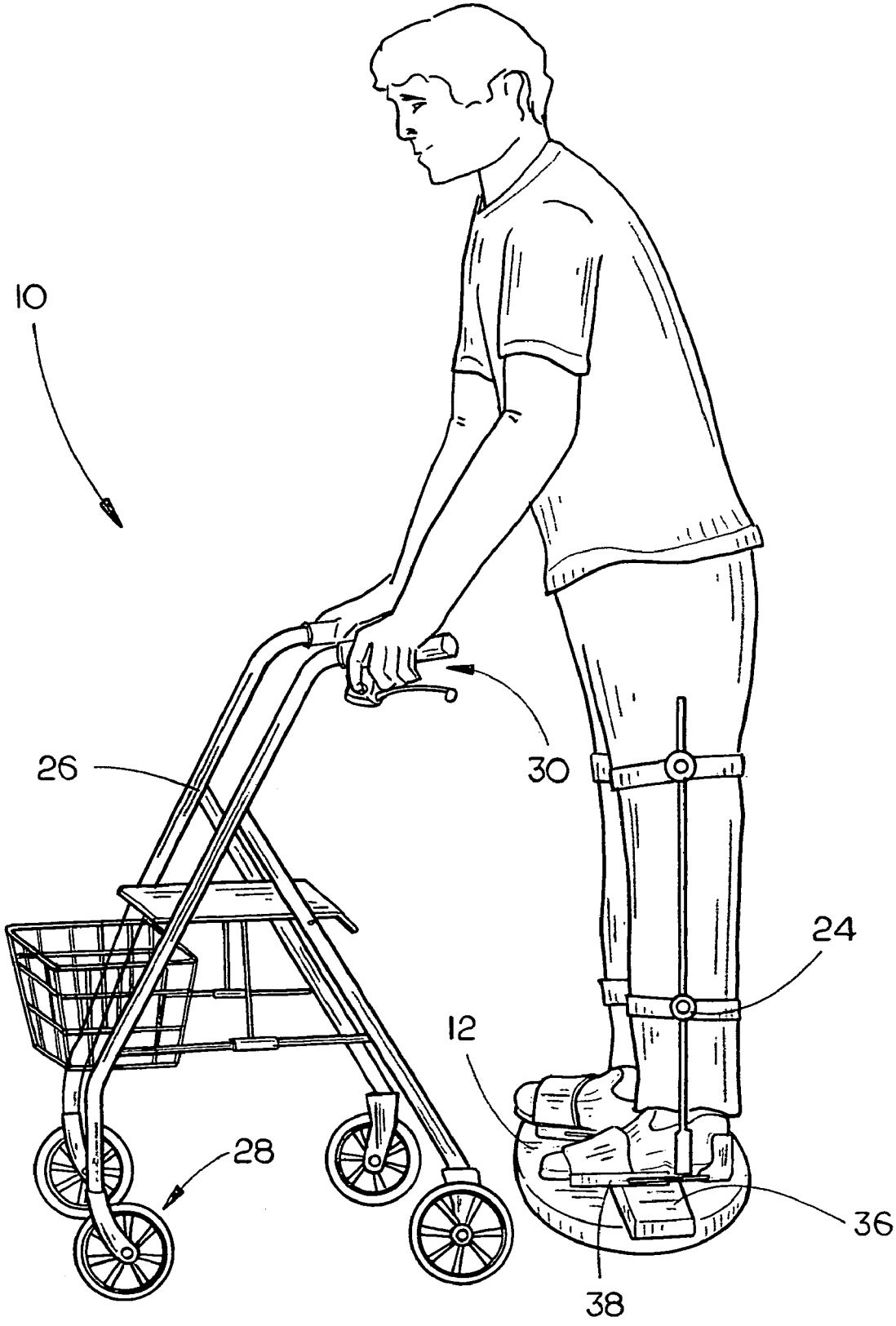
FIG. 1 is an isometric view of one embodiment of the system for assisting ambulation of the present invention as the same could be used by an individual.
Figure 2:
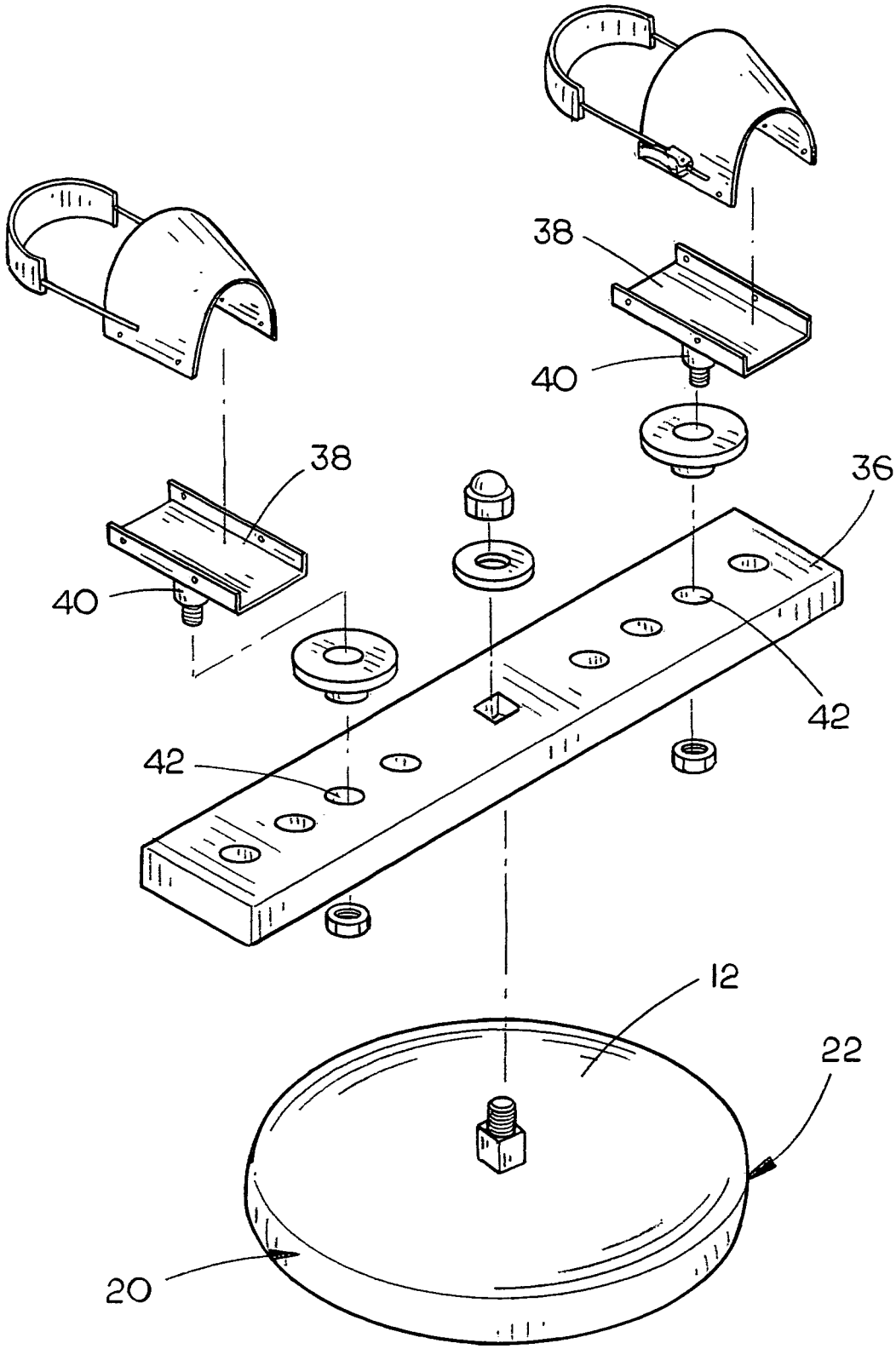
FIG. 2 is an exploded view of one embodiment of an ambulation device of the present invention.

The system 10 for assisting individual ambulation will be disclosed herein as providing ambulation assistance to individuals who have varying degrees of lower body paralysis. However, it will become apparent to those having skill in the art that the system 10 may be used by individuals of various physical afflictions, or those having no affliction whatsoever, for ambulation and total-body, therapeutic exercise. Accordingly, the system 10 will be described herein as the same could be used by a paraplegic for purposes of description only and not for purposes of limitation.

The system 10 is provided with a base 12 having a bottom portion 14, a peripheral edge portion 16, an upper end portion 18, and first and second side portions 20 and 22. The bottom portion 14 is adapted to be supported on nearly any operating surface. While other alternate embodiments will be discussed hereinbelow, the upper end portion 18 is adapted to receive the individual's feet and support the individual in a generally upright, standing position. Depending upon the level of lower extremity paralysis, it is contemplated that the individual will wear a set of leg braces of varying length, support and overall function, to permit the individual to stand on the base 12. Such leg braces will be known to those having skill in the art and, due to the variance in the needs of each individual user, the leg braces 24 will not be discussed in greater detail herein.

The system 10 is also preferably provided with a means that permits the individual to selectively engage the operating surface by using the individual's upper extremities. This means may be provided in the form of a support frame 26, having a ground engagement portion 28 and a gripping portion 30. One example of such a support frame 26 is the wheeled walker, depicted in FIG. 1. Such a support frame 26 provides the individual with adequate support and balance when standing on the base 12. It is contemplated that the ground engagement portion 28 may be provided with a plurality of fixed or pivoting wheels, as depicted in FIG. 1, or simply provided with post ends of various materials, skids, or platforms of various shapes. As discussed in greater detail hereinbelow, it is simply preferred that the ground engagement portion 28 of the support frame 26 enable the individual to move the support frame 26 in a generally forward direction over the operating surface while further providing a sufficient nature of engagement with various types of operating surfaces to permit the individual to selectively secure the position of the support frame 26 with respect to the operating surface. Where wheels or casters are provided to the ground engagement portion, a simple braking system may be provided to resist the unintentional rotation of the wheels and help retain the position of the support frame 26 with respect to the operating surface. While the support frame 26 depicted in FIG. 1 is presented with four legs, nearly any configuration and number of legs is contemplated. It is further contemplated that a pair of elongated support frames 26 could be used, such as a pair of crutches, ski poles, or the like. Likewise, an elongated support frame 26 could be provided to have a ground engagement portion 28 comprising one or more spikes or plates that engage the operating surface to provide a greater engagement force, where desired.

Figure 3:
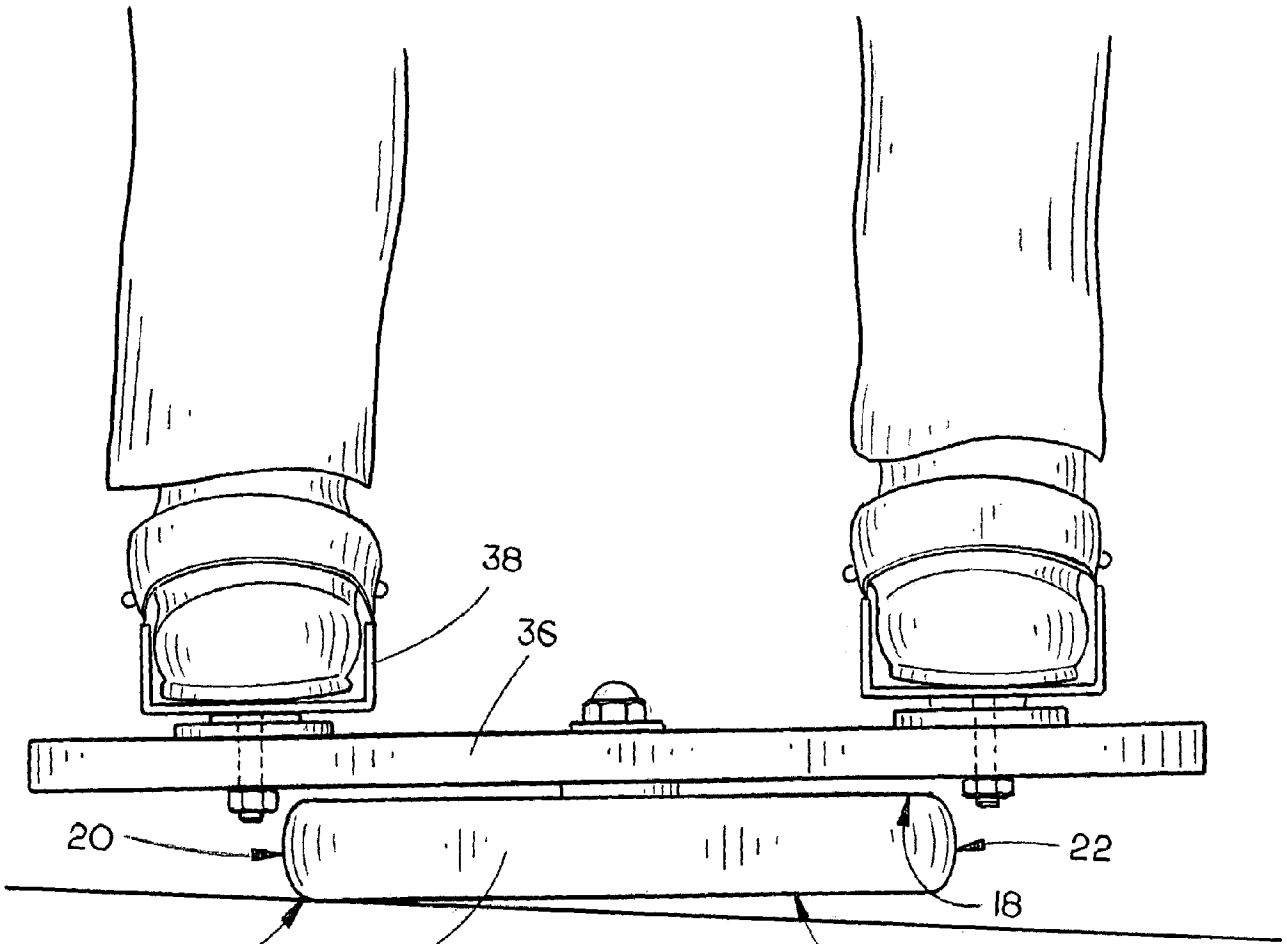
FIG. 3 is a front elevation view of the ambulation device of FIG. 2 as the same could be used by an individual and further depicts one manner of shifting a preponderance of the individual's mass to one side of the ambulation device.

In use, the individual stands adjacent the upper end portion 18 of the base 12 and grasps the support frame 26, similar to the manner depicted in FIG. 1. Preferably, the support frame 26 is positioned in front of the base 12 in a spaced distance of anywhere from a few inches to a foot or more. The individual begins by shifting a preponderance of his mass adjacent the first side portion 20 of the base 12, as depicted in FIG. 3. This will cause the base 12 to tilt in a manner similar to that depicted so that the second side portion 22 is no longer in engagement with the operating surface. Being careful to engage the support frame 26 with the operating surface so that they generally remain in a static position with respect to one another, the individual pulls on a portion of the support frame 26 with his upper extremities so that the second side portion 22 of the base 12 moves, along with his lower extremities, in a generally forward direction toward the support frame 26. Continued pivoting of the base 12 will tend to turn the individual away from the forward direction. This provides the individual with an easy means for changing direction during ambulation. Accordingly, forward or turning movements can be achieved through a simple pivoting motion, which requires a lower energy expenditure by the individual than other known devices and methods of ambulation.

Figure 4:
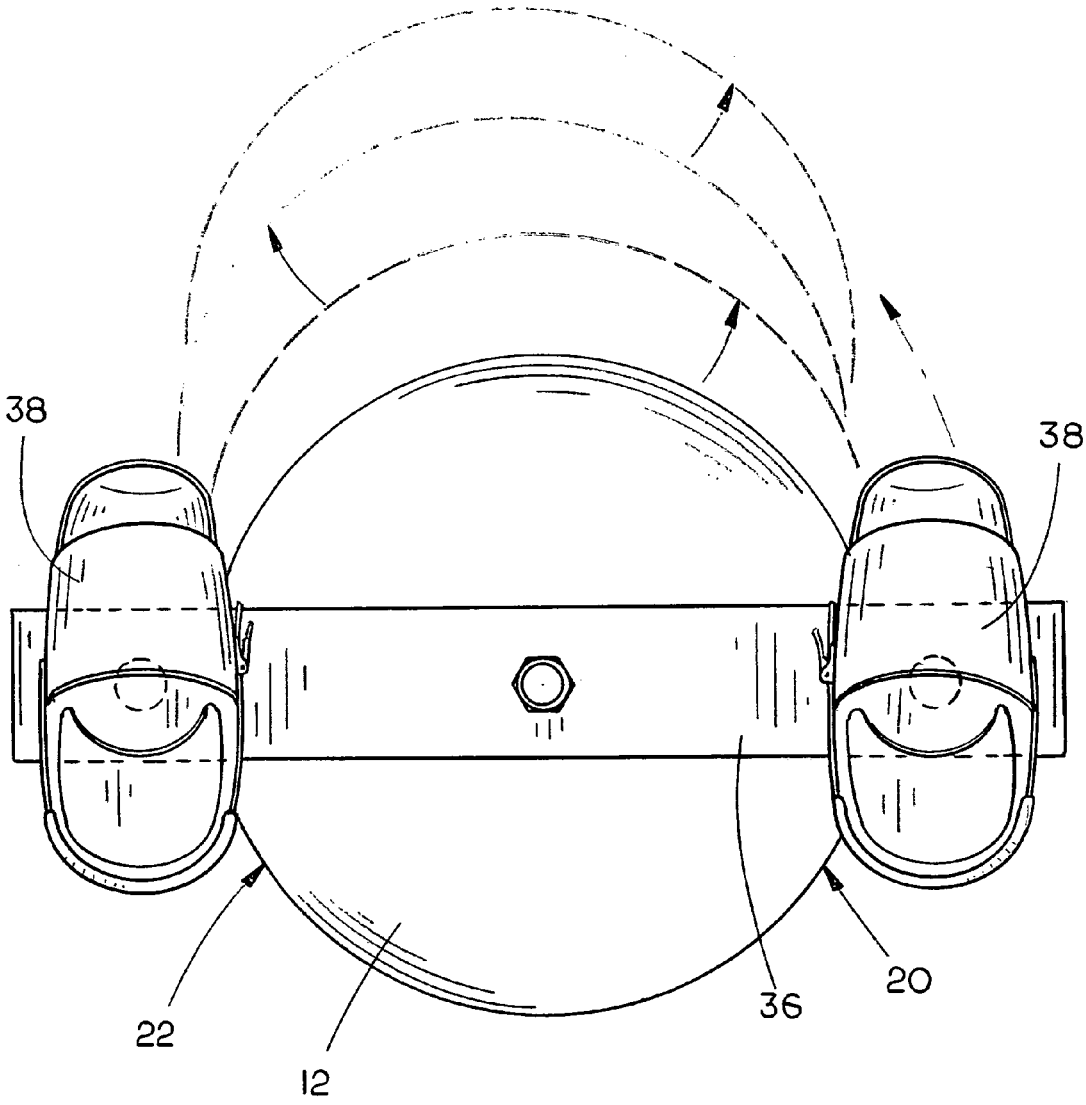
FIG. 4 is a plan view of the ambulation device of FIG. 3 as the same could be moved by an individual in a generally forward direction.

To continue a forward direction of travel, the individual then shifts his mass closer to a middle portion of the base 12 so that the base is in stable engagement with the operating surface. The individual then shifts his mass so that a preponderance of his mass is positioned adjacent the second side portion 22 of the base 12. The individual then pulls on a portion of the support frame 26 with his upper extremities so that the first side portion 20 of the base 12 moves in a generally forward direction, transporting his lower extremities toward the support frame 26. FIG. 4 depicts these forward motions of the base 12 in a general sense. A similar but reverse movement with respect to the support frame 26 is easily achieved by having the individual push, rather than pull, on a portion of the support frame 26 with his upper extremities so that the first side portion 20 of the base 12 moves in a generally rearward direction, transporting his lower extremities away from the support frame 26. It is also contemplated that individuals having some or complete control over their lower extremities may use their lower extremities to help the pivoting motion of the base 12 and reducing the amount of pulling or pushing force required by the upper extremities.

Figures 5A, 5B, 6A, 6B, 7A, 7B, 8A, 8B, 9A, 9B, 10A, 10B:
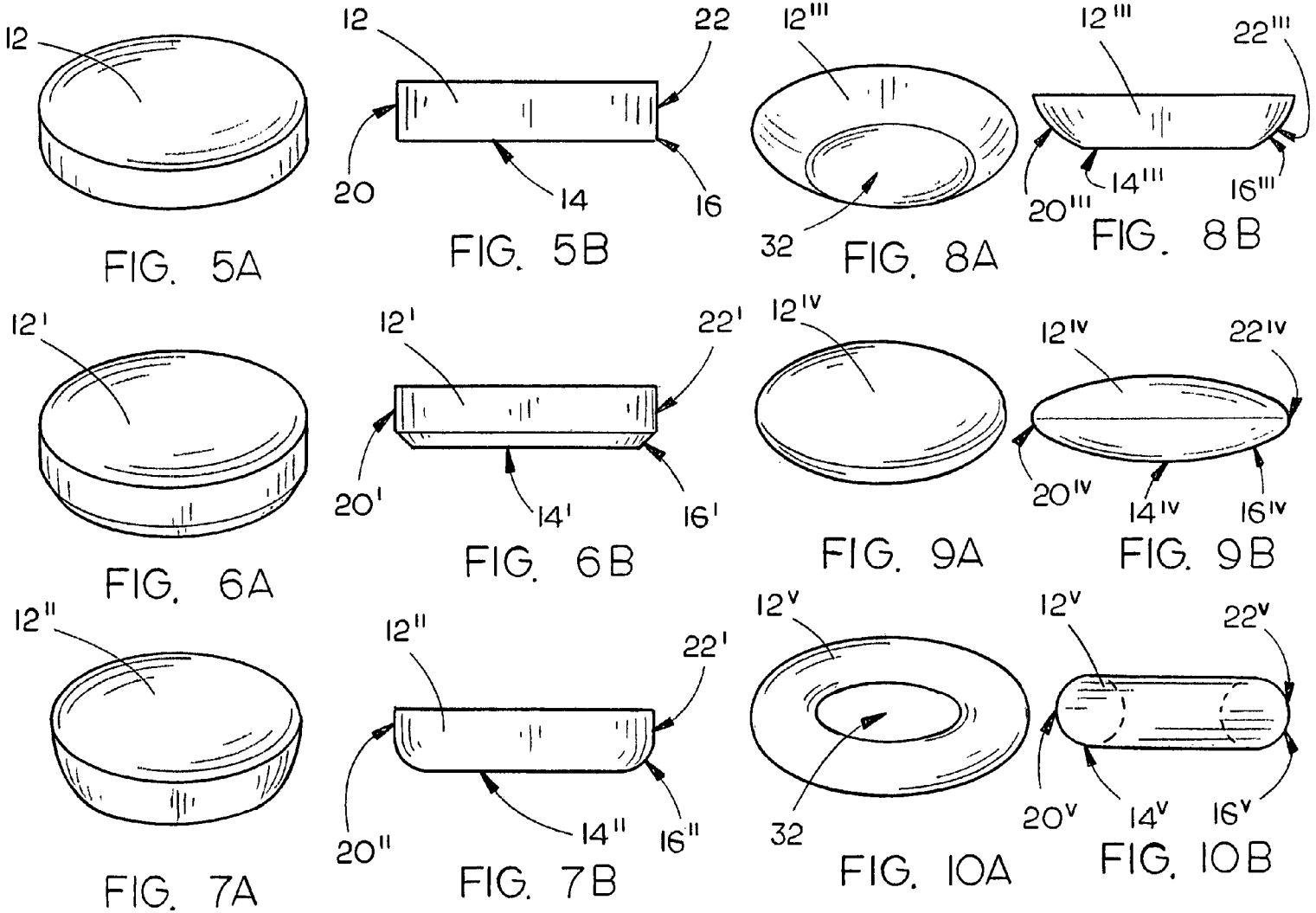
FIG. 5A is an isometric view of one embodiment of the base of the ambulation device of the present invention.
FIG. 5B is an elevation view of the base depicted in FIG. 5A.
FIG. 6A is an isometric view of another embodiment of the base of the ambulation device of the present invention.
FIG. 6B is an elevation view of the base depicted in FIG. 6A.
FIG. 7A is an isometric view of a further embodiment of the base of the ambulation device of the present invention.
FIG. 7B is an elevation view of the base depicted in FIG. 7A.
FIG. 8A is an isometric view of still another embodiment of the base of the ambulation device of the present invention.
FIG. 8B is an elevation view of the base depicted in FIG. 8A.
FIG. 9A is an isometric view of yet another embodiment of the base of the ambulation device of the present invention.
FIG. 9B is an elevation view of the base depicted in FIG. 9A.
FIG. 10A is an isometric view of another embodiment of the base of the ambulation device of the present invention.
FIG. 10B is an elevation view of the base depicted in FIG. 10A.

As depicted in the Figures, shifting of the individual's mass causes one side portion of the base 12 to lift in an upward direction. This may cause the base 12 to substantially or entirely disengage its bottom portion 14 with the operating surface. The peripheral edge portion 16 may then become engaged with the operating surface to provide the surface on which the base 12 may pivot. FIGS. 5A and 5B depict one embodiment of the base 12 where the bottom portion 14 and the side portions 20 and 22 meet to create a peripheral edge 16 having an angular profile. Specifically, as depicted in FIGS. 5A and 5B, the peripheral edge portion 16 is provided with a generally right-angle profile. It is contemplated however that the angle may be formed to be acute or obtuse, depending on the desired configuration of the base 12.

FIGS. 6A and 6B of the base 12', which illustrates a peripheral edge portion 16' that is formed in a chamfered profile. In this configuration, a somewhat stable and repeatable position can be obtained for pivoting the base 12'. Similarly, FIGS. 7A and 7B depict a base $\mathbf{12}^{ii}$, wherein the peripheral edge portion $\mathbf{16}^{ii}$ is provided with a radiused profile. Such a profile will provide a smoother transition from the bottom portion $\mathbf{14}^{ii}$ to the peripheral edge $\mathbf{16}^{ii}$ but may lack some of the stability exhibited by the peripheral edge portion $\mathbf{16}^{i}$.

In still another embodiment, depicted in FIGS. 8A and 8B, the base $\mathbf{12}^{iii}$ is provided in a generally parabolic-shape. The bottom portion $\mathbf{14}^{iii}$ is formed by cutting or flattening the lower end portion of the parabolic-shape. It is contemplated that an opening 32 may be formed through the bottom portion $\mathbf{14}^{iii}$, which will provide some manner of traction on softer operating surfaces, such as soil or grass. Depending on the shape and location of the opening 32, greater medial-lateral and anterior-posterior stability will also be achieved for the individual standing on the base $\mathbf{12}^{iii}$. The parabolic-shape of the base $\mathbf{12}^{iii}$ is similar in nature to the radiused profile provided to the base $\mathbf{12}^{ii}$, but extends a much greater distance along the side portions of the base $\mathbf{12}^{iii}$ and creates a more gradual radiused profile to provide a greater range of tilting capacity in the base $\mathbf{12}^{iii}$. It is contemplated that the diameter of the base $\mathbf{12}^{iii}$ may vary from one individual use to another. For example, the individual will tend to find that manipulation of the base $\mathbf{12}^{iii}$ on a softer operating surface becomes easier as the diameter of the base $\mathbf{12}^{iii}$ is increased.

In yet another embodiment, the base $\mathbf{12}^{iv}$ is provided in a generally discus-shape, wherein the curved or parabolic shape of the base is much more gradual than that provided in the base $\mathbf{12}^{iii}$. Such an easing of the peripheral edge portion will lessen the degree to which the base is permitted to tilt. This creates an increase in medial-lateral and anterior-posterior stability and provides a more stable pivot point for individuals having a lesser degree of balance and dexterity. In another embodiment, depicted in FIGS. 10A and 10B, the base $\mathbf{12}^{v}$ is provided with a ring-shape that forms an opening 32 in the bottom portion $\mathbf{14}^{v}$ but provides a circular or ovular cross section to the base $\mathbf{12}^{v}$. Accordingly, a radiused profile is provided to the peripheral edge portion $\mathbf{16}^{v}$ that is similar to that exhibited by the base $\mathbf{12}^{iii}$, but is provided with an inner edge portion 34, having a radiused profile, to generally reduce some of the frictional engagement that may occur on some operating surfaces.

Figure 11:
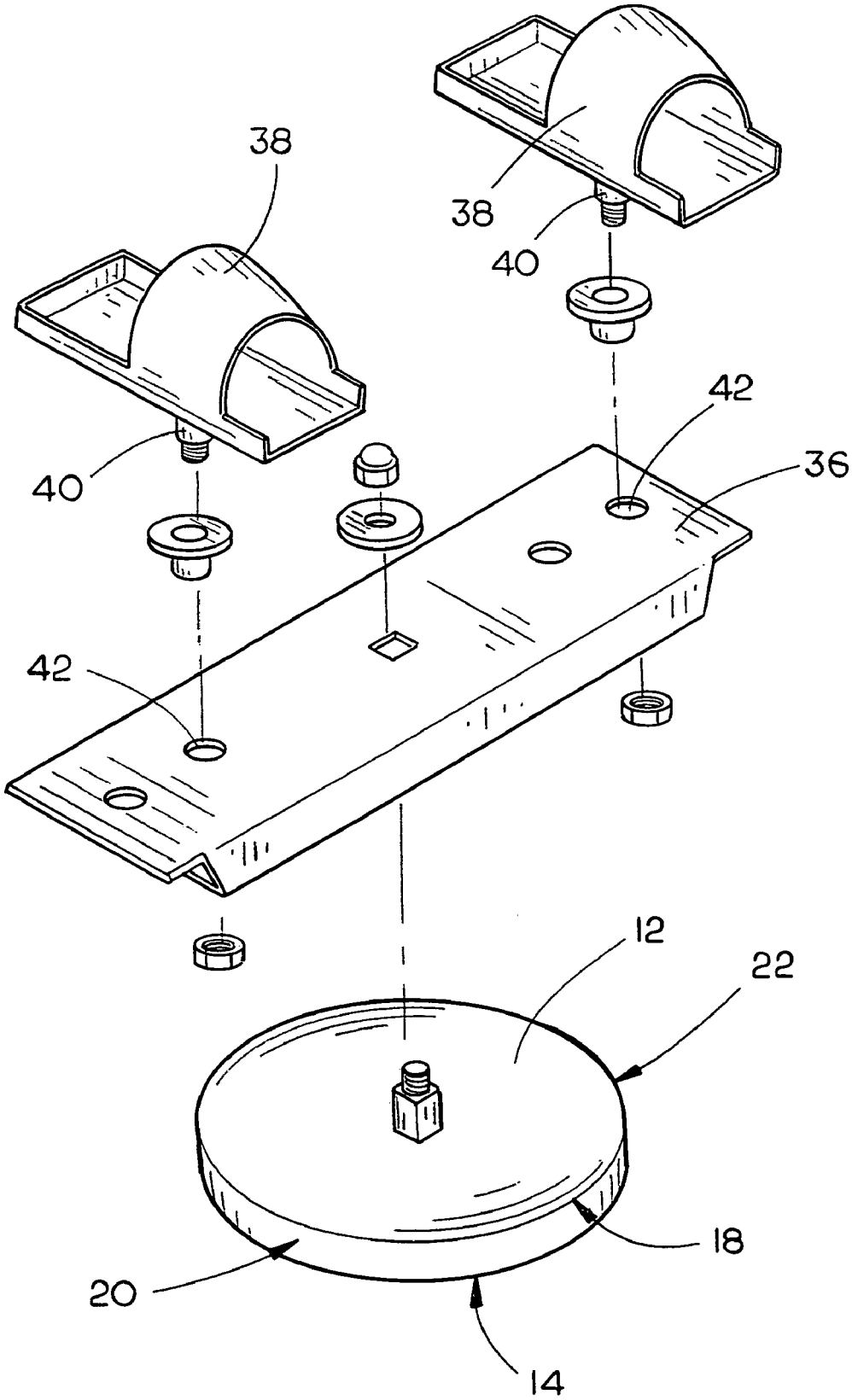
FIG. 11 is an exploded view of an alternate embodiment of the ambulation device of the present invention.

A platform 36 may be operatively coupled to the upper end portion 18 of the base 12. The platform 36 provides a stable structure on which the individual can stand and, depending upon the diameter of the base 12, may provide a greater lever arm for use in tilting the base 12. Pairs of foot retainers 38 may be provided to secure the individual's feet to the platform 36. In one preferred embodiment, the foot retainers 38 may be pivotably coupled with the platform 36 by securing posts 40, which extend downwardly from the bottom of the foot retainers 38, through sockets 42 formed through the platform 36. As depicted in FIG. 11, a plurality of sockets 42 may be provided along a transverse axis of the platform 36 in order to provide an adjustability to the stance in which the individual assumes when standing on the platform 36. A broader stance will provide a greater ease in tilting and pivoting the base 12, creating more leverage, whereas the more narrow base position will be easier for smaller individuals to use. Adjustments to the height of the platform 36 with respect to the base 12 are also contemplated to increase the degree of leverage obtainable (raising the platform 36) or make the system 10 more stable (lowering the platform 36).

Figure 12:
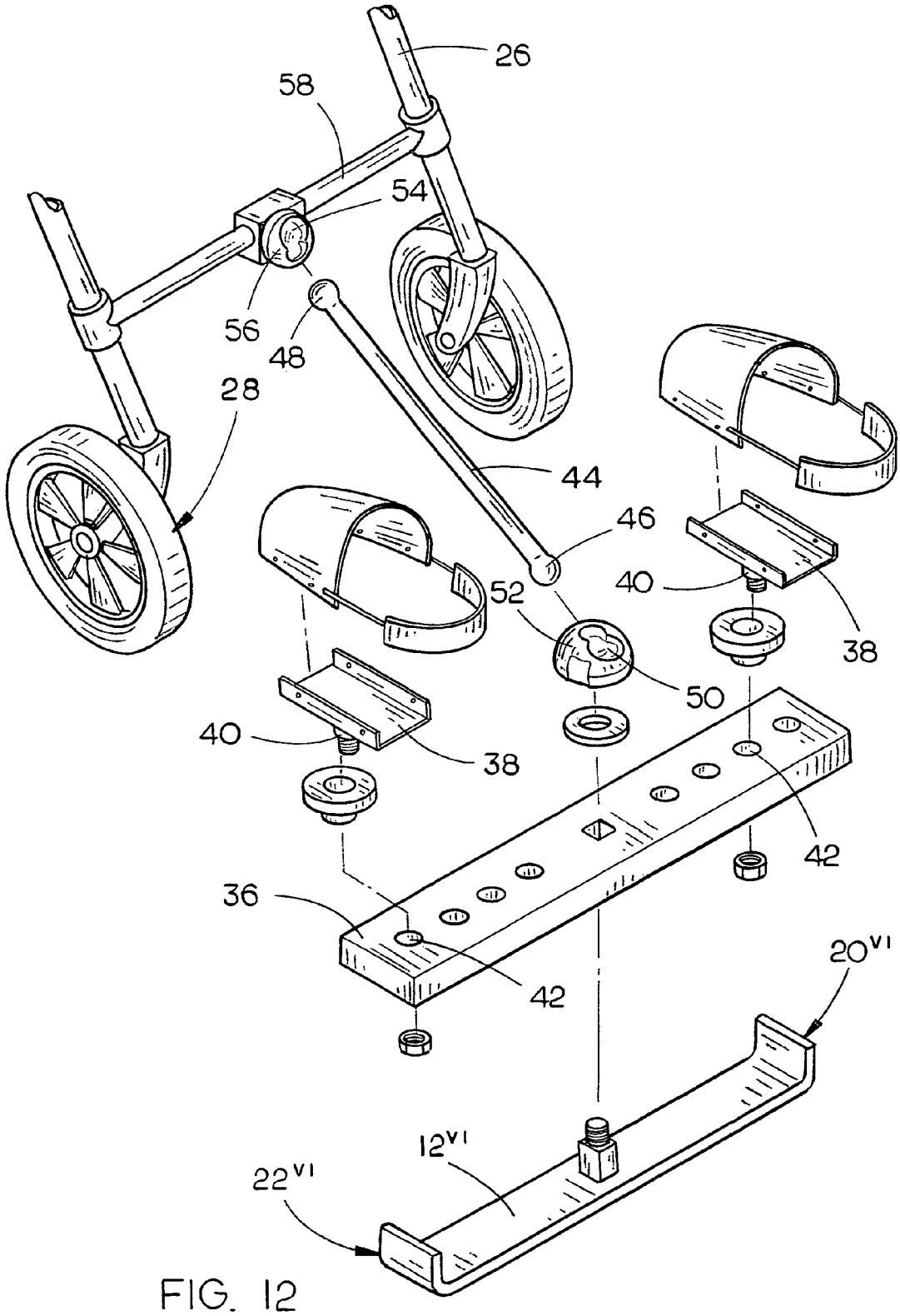
FIG. 12 is an isometric, partially exploded view of still another alternate embodiment of the ambulation assistance device of the present invention.

FIG. 12 depicts an alternate embodiment of the system 10, which demonstrates that the base may be irregular in shape and need not be generally circular in nature. The generally U-shaped base $\mathbf{12}^{vi}$ is elongated with generally upstanding opposite side portions 20 and 22 and a flat bottom portion. It is contemplated, however, that the angular relationship of the opposite side portions 20 and 22 with respect to the horizontal may be increased or decreased substantially, according to the circumstances presented. Similarly, the bottom portion may be angular or parabolic to a slight or extreme degree. However, the general operation of the system 10 will not change due to the unique shape of the base $\mathbf{12}^{vi}$.

Further depicted in FIG. 12 is a connecting bar 44, having first and second end portions 46 and 48, that serves as a linkage means for exerting a pulling or pushing force on the base $\mathbf{12}^{vi}$ through manipulation of the support frame 26. The first end portion 46 is received within the socket 50 of a retainer 52 that is secured to the platform 36 or the base 12$^{vi}$, in the alternative. The second end portion 48 is received within the socket 54 of a retainer 56, which is secured to a brace 58 on the support frame 26. In use, the support frame is used like a lever, first engaged with the operating surface at the lower end and then pushed at its gripping end portion 30 in a generally forward direction. Where the support frame is a wheeled walker, for example, the individual will push the walker in a forward direction with its forward wheels in the air and its rearward wheels on the ground. The individual then engages the operating surface with the walker by actuating the brakes and simply pushes the forward wheels in a downward and forward direction until they meet the operating surface. This motion causes a pulling force on the linkage 44, which is transmitted to the base 12$^{vi}$, pulling it in a forward direction. Performing the series of movements in reverse will cause a pushing force on the linkage 44, which will transmit a pushing force to the base 12$^{vi}$. It is contemplated that the individual may elect to perform these same movements simultaneously with the pivoting and pulling (or pushing) movements described hereinabove to assist the ambulation process. It is also contemplated that other linkage means could be used. For example, chain, rope, wire, or the like could be used in place of the linkage 44, where a pushing force is not desired. Moreover, the linkage 44 and its contemplated substitutes need not be secures to the system using the retainers 52 or 56, only a secure connection is required. However, the ball and socket arrangement depicted may provide for a smoother action between the component parts. Likewise, the brace 58 need not be used. Rather the linkage, which could be provided in a Y-shape (or the like) to secure to the legs of the support frame 26.

Figure 13:
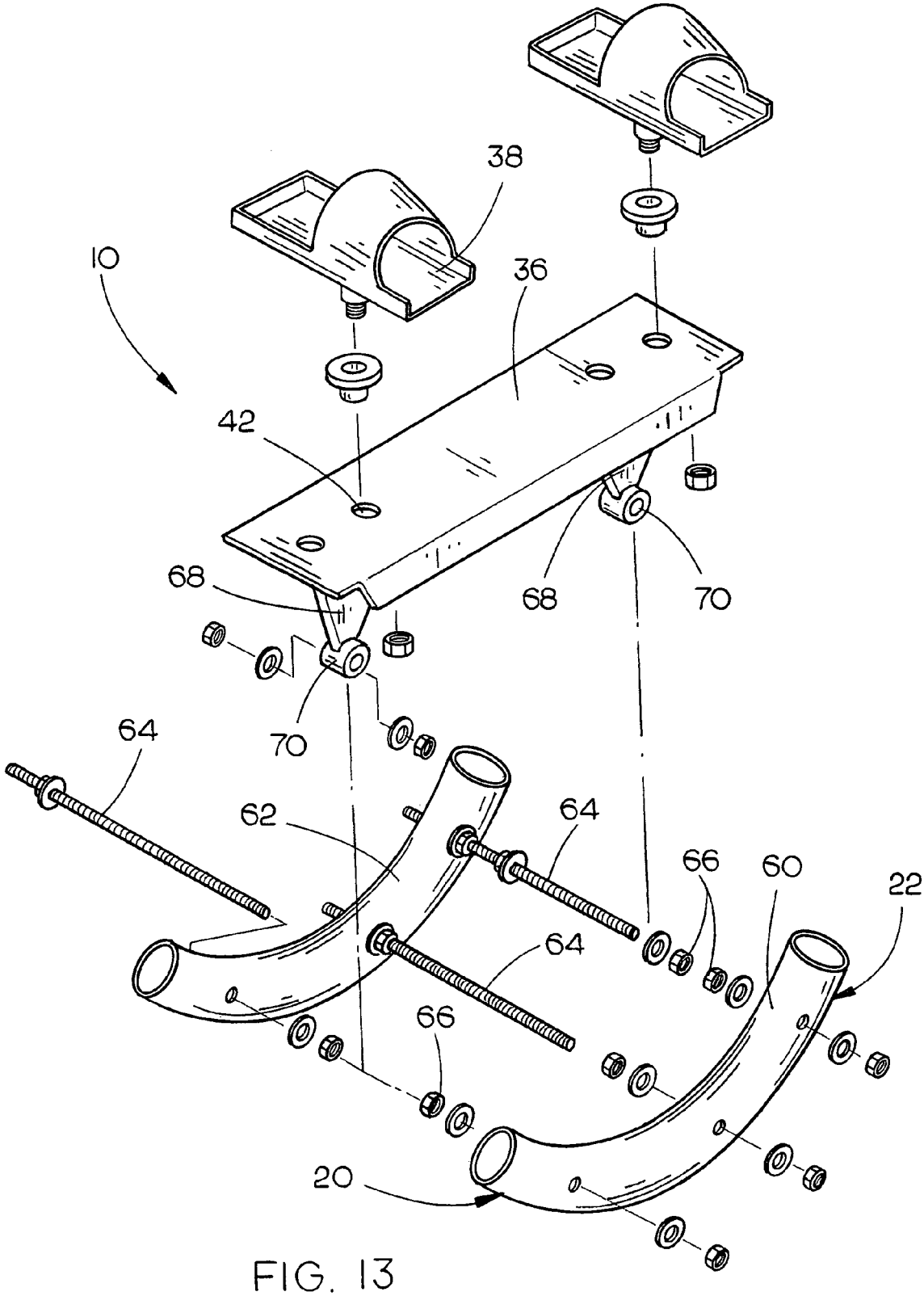
FIG. 13 is an isometric, partially exploded view of yet another alternate embodiment of the ambulation assistance device of the present invention.

FIG. 13 depicts another embodiment of the system 10, further demonstrating that the base may be irregular in shape and need not be circular in nature. The base 12$^{vii}$ is provided with at least one generally U-shaped member 60 having upstanding opposite side portions 20 and 22. As depicted, the U-shaped member 60 is provided with a generally circular cross sectional shape. However, it is contemplated that the cross section could be provided in nearly any shape, including ovular, square, rectangular, triangular, hexagonal, and the like. Providing a flattened or opened bottom portion will provide increased medial-lateral and anterior-posterior stability. However, anterior-posterior stability can also be increased by providing one or more additional U-shaped members 62 and coupling them adjacent the first U-shaped member 60. Accordingly, while two U-shaped members are depicted in FIG. 13, it is contemplated that three or more U-shaped members could be coupled one in front of the other. Moreover, while the second U-shaped member 62 is depicted as being similar in size and shape to the first U-shaped member 60, it is contemplated that the second U-shaped member 62 could be provided to be smaller or larger as well as in shapes different from the first U-shaped member 60. Changes in the diameter of the U-shaped members, their curvature and their length will tend to affect anterior-posterior and medial-lateral stability accordingly. Increases in these proportions, as well as the distance with which they are coupled to one another will tend to increase the heal and toe levers available to an individual using the device. Likewise, such changes in proportional sizes and dimensions will adjust static and dynamic stability, accordingly.

The U-shaped members depicted in FIG. 13 are generally coupled to one another using a plurality of elongated rods 64. In one preferred embodiment, the elongated rods 64 are threaded so that they may receive threaded nuts or other such fasteners 66 on either side of the individual U-shaped members to secure them in position along the lengths of the elongated rods 64 and with respect to one another. Other brackets and plate members are contemplated for substitution with the elongated rod members according to the circumstances presented. Fewer or greater numbers of elongated rods 64 are also contemplated.

An elongated platform 36 may be provided and used in conjunction with the base as described previously for alternate base embodiments. It is preferred however that a pair of platform supports 68 be provided on either side of the platform 36 to operatively receive the elongated rod members 64. Fasteners 66 can be provided to engage the opposite sides of collars 70, which are coupled at the lower ends of the platform supports 68. Increasing or decreasing the height of the platform supports 68 or the position in which the operatively engage the base 12$^{vii}$ will alter the center of gravity for the system 10 and adjust the static and dynamic stability of the system accordingly.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A method of ambulating an individual with upper and lower extremities from one location to another across an operating surface, comprising the steps of:

providing an ambulation device comprising a base having a bottom portion, a peripheral edge portion, opposite first and second side portions, and an upper end portion;

providing means for selective manual engagement with the operating surface using the individual's upper extremities; said means generally having opposite first and second side portions;

standing the individual in operative engagement with the upper end portion of said base;

operatively engaging the individual's upper extremities with said means so that said means is generally positioned in front of the individual in a spaced relationship with said base;

shifting a preponderance of the individual's mass toward the first side portion of said base;

engaging said means with the operating surface so that the means and the operating surface generally remain in a static position with respect to one another;

pulling on a portion of said means with the individual's upper extremities so that the second side portion of said base and the individual's lower extremities move generally toward the second side portion of said means;

shifting a preponderance of the individual's mass toward the second side portion of said base; and pulling on a portion of said means so that the first side portion of said base moves generally toward the first side portion of said means.

2. The method of claim 1 wherein the peripheral edge portion of said base is provided with a radiused profile.

3. The method of claim 1 wherein the peripheral edge portion of said base is provided with a chamfered profile.

4. The method of claim 1 wherein the peripheral edge portion of said base is formed at an intersection of the bottom portion and the sides of said base to create a peripheral edge having an angular profile.

5. The method of claim 4 wherein the peripheral edge portion is provided with a generally right-angle profile.

6. The method of claim 1 wherein the bottom of said base is provided with an open portion.

7. The method of claim 6 wherein said base is generally ring-shaped.

8. The method of claim 7 wherein the peripheral edge portion of said base is provided with a radiused profile.

9. The method of claim 1 wherein said means is a walker having a frame, a handle and legs that are adapted to operatively engage the operating surface.

10. The method of claim 9 wherein said walker is further provided with wheels operatively coupled with said legs and a braking system operatively coupled with said wheels that is selectively engageable to resist movement of said walker with respect to the operating surface.

11. The method of claim 1 wherein said means is comprised with a pair of elongated frame members, each having gripping end portions and operating surface engagement end portions.

12. The method of claim 1 wherein said base is further provided with a platform coupled with the upper end portion of said base that is adapted to support the individual.

13. The method of claim 12 wherein said means is a walker having a frame, a handle and legs that are adapted to operatively engage the operating surface.

14. The method of claim 13 wherein said walker is further provided with wheels operatively coupled with said legs and a braking system operatively coupled with said wheels that is selectively engageable to resist movement of said walker with respect to the operating surface.

15. The method of claim 1 wherein the individual pushes on a portion of said means with the individual's upper extremities, rather than pulling, so that the second side portion of said base and the individual's lower extremities move generally away from the second side portion of said means.

16. The method of claim 1 wherein said base is generally U-shaped.

17. The method of claim 1 further comprising the step of providing linkage means for operatively coupling said ambulation device with said means for selective manual engagement with the operating surface so that said means for selective manual engagement with the operating surface may be selectively manipulated to enact a pulling force on said ambulation device.

18. The method of claim 17 wherein said means for selective manual engagement with the operating surface may be selectively manipulated to enact a pushing force on said ambulation device.

19. The method of claim 16 wherein said base is formed from a plurality of generally U-shaped members.

20. A method of ambulating an individual, with upper and lower extremities, from one location to another, across an operating surface, comprising the steps of:

providing an ambulation device comprising a base having a bottom portion, a peripheral edge portion, opposite first and second side portions, and an upper end portion;

said base being further comprised of a pair of foot receptacles operatively coupled with said platform to secure the individual's feet to said base;

providing means for selective manual engagement with the operating surface using the individual's upper extremities; said means generally having opposite first and second side portions;

standing the individual in operative engagement with the upper end portion of said base;

operatively engaging the individual's upper extremities with said means so that said means is generally positioned in front of the individual in a spaced relationship with said base;

shifting a preponderance of the individual's mass toward the first side portion of said base;

engaging said means with the operating surface so that the means and the operating surface generally remain in a static position with respect to one another;

pulling on a portion of said means with the individual's upper extremities so that the second side portion of said base and the individual's lower extremities move generally toward the second side portion of said means;

shifting a preponderance of the individual's mass toward the second side portion of said base; and pulling on a portion of said means so that the first side portion of said base moves generally toward the first side portion of said means.

21. A method of ambulating an individual, with upper and lower extremities, across an operating surface, comprising the steps of:

providing an ambulation device comprising a base having a bottom portion, a peripheral edge portion, opposite first and second side portions, and an upper end portion;

said base being further provided with a platform with the upper end portion of said base that is adapted to support the individual;

said means being a walker having a frame, a handle and legs that are adapted to operatively engage the operating surface;

said walker being further provided with wheels operatively coupled with said legs and a braking system operatively coupled with said wheels that is selectively engageable to resist movement of said walker with respect to the operating surface;

said base being further comprised of a pair of foot receptacles operatively coupled with said platform to secure the individual's feet to said base;

providing means for selective manual engagement with the operating surface using the individual's upper extremities; said means generally having opposite first and second side portions;

standing the individual in operative engagement with the upper end portion of said base;

operatively engaging the individual's upper extremities with said means so that said means is generally positioned in front of the individual in a spaced relationship with said base;

shifting a preponderance of the individual's mass toward the first side portion of said base;

engaging said means with the operating surface so that the means and the operating surface generally remain in a static position with respect to one another;

pulling on a portion of said means with the individual's upper extremities so that the second side portion of said base and the individual's lower extremities move generally toward the second side portion of said means;

shifting a preponderance of the individual's mass toward the second side portion of said base; and pulling on a portion of said means so that the first side portion of said base moves generally toward the first side portion of said means.

22. A method of ambulating an individual, with upper and lower extremities, across an operating surface, comprising the steps of:

providing an ambulation device comprising a base having a bottom portion, a peripheral edge portion, opposite first and second side portions, and an upper end portion;

said base being generally U-shaped;

said base being formed from a plurality of generally U-shaped members;

said plurality of generally U-shaped members being operatively coupled to one another so that said U-shaped members are positioned to be in a horizontally spaced relationship with one another;

providing means for selective manual engagement with the operating surface using the individual's upper extremities; said means generally having opposite first and second side portions;

standing the individual in operative engagement with the upper end portion of said base;

operatively engaging the individual's upper extremities with said means so that said means is generally positioned in front of the individual in a spaced relationship with said base;

shifting a preponderance of the individual's mass toward the first side portion of said base;

engaging said means with the operating surface so that the means and the operating surface generally remain in a static position with respect to one another;

pulling on a portion of said means with the individual's upper extremities so that the second side portion of said base and the individual's lower extremities move generally toward the second side portion of said means;

shifting a preponderance of the individual's mass toward the second side portion of said base; and pulling on a portion of said means so that the first side portion of said base moves generally toward the first side portion of said means.

23. The method of claim 20 wherein said foot receptacles are each pivotably coupled with said platform.

24. The method of claim 21 wherein said foot receptacles are each pivotably coupled with said platform.

25. The method of claim 22 wherein said plurality of generally U-shaped members are positioned to be generally parallel with one another.

* * * * *